US008359682B2

(12) United States Patent
Brunelle et al.

(10) Patent No.: US 8,359,682 B2
(45) Date of Patent: Jan. 29, 2013

(54) BATHTUB SUPPORT STRUCTURE WITH DECORATIVE PANEL COMPONENTS AND METHOD

(75) Inventors: Henry Brunelle, Québec (CA); Louis Gendreau, Sainte-Marie (CA); Christian Blanchette, St-Etienne de Lauzon (CA); Pascale Vaillancourt, Saint Romuald (CA); François Busque, St-Etienne de Lauzon (CA)

(73) Assignee: Gestion Ultra Internationale Inc., St-Nicolas (CA)

( * ) Notice: Subject to any disclaimer, the term of this patent is extended or adjusted under 35 U.S.C. 154(b) by 162 days.

(21) Appl. No.: 12/891,044

(22) Filed: Sep. 27, 2010

(65) Prior Publication Data

US 2011/0072576 A1 Mar. 31, 2011

(30) Foreign Application Priority Data

Sep. 28, 2009 (CA) ..... 2680902

(51) Int. Cl.
*A47K 3/022* (2006.01)

(52) U.S. Cl. ..... 4/592

(58) Field of Classification Search ..... 4/538–595
See application file for complete search history.

(56) References Cited

U.S. PATENT DOCUMENTS

| | | | | |
|---|---|---|---|---|
| 2,841,795 | A | 7/1958 | Pelicano | |
| 4,970,734 | A * | 11/1990 | Friedman et al. | 4/597 |
| 5,430,898 | A * | 7/1995 | Wang | 4/592 |
| 5,477,568 | A | 12/1995 | Wang | |
| 6,269,494 | B1 * | 8/2001 | Moretto | 4/584 |
| 6,349,427 | B1 * | 2/2002 | Bergstrom | 4/541.1 |
| 7,278,175 | B2 * | 10/2007 | Torres | 4/584 |

* cited by examiner

*Primary Examiner* — Lori Baker
(74) *Attorney, Agent, or Firm* — Norton Rose Canada LLP

(57) ABSTRACT

A bathtub support structure and method of construction is described. The support structure comprises a support frame structure formed of vertical support posts and lateral frame members for interconnecting the vertical post at predetermined locations in the support frame structure. Each of the vertical support posts has an adjustable support foot at a top end thereof. At least two spaced-apart adjustable connectors are adjustably secured to at least some of the vertical support posts and displaceable along a substantially horizontal axis. The connectors have an outer attachment head formed of a material for removable magnetic attachment to outer decorative panel components. The panel components have magnetic connecting inserts secured to an inner surface thereof.

13 Claims, 4 Drawing Sheets

BATHTUB SUPPORT STRUCTURE WITH DECORATIVE PANEL COMPONENTS AND METHOD

TECHNICAL FIELD

The present invention relates to a bathtub support structure with decorative panel components and method of construction and particularly for use in the construction of free standing bathtubs and for converting existing bathtubs into free standing bathtubs.

BACKGROUND ART

Various frame structures and attachments are known for removably connecting side panels to bathtubs whereby to rejuvenate existing bathtubs by providing more aesthetically pleasing side walls, be it in design or color. Such rejuvenation is much less expensive than having to replace an existing bathtub particularly if the model and size of the bathtub is discontinued as it may be difficult to refit a bathtub in a restricted recessed wall space. An example of such structure is described in U.S. Pat. No. 2,841,795.

It is also known to provide support structures for free-standing, drop-in type bathtubs and such is described, for example, in U.S. Pat. Nos. 5,477,568 and 6,269,494. However, such systems are specifically adapted for bathtubs of a specific design and the support structure is not modifiable to adapt to various other types of bathtubs. They are also not suitable for converting existing bathtubs, which are supported in recessed wall cavities, to free-standing bathtubs which are accessible from all sides and visible from all sides. The structures described in the above-referenced two patents also require expert labour for its asssembly. They are also not flexible to provide add-ons to existing perimeter portions or rims of bathtubs.

SUMMARY OF INVENTION

It is a feature of the present invention to provide a bathtub support structure which substantially overcomes the above-mentioned disadvantages of the prior art.

Another feature of the present invention is to provide a bathtub support structure which has a support frame structure formed of vertical support posts and lateral frame members interconnectable together and provided with adjustable means to secure to different types of bathtubs and different sizes of outer panel components.

Another feature of the present invention is to provide a bathtub support structure for converting existing recessed bathtub structures to free-standing drop-in bathtubs and wherein the free-standing structure may have the appearance of an article of furniture.

Another feature of the present invention is to provide a method of constructing a free-standing bathtub support kit and enclosure.

According to the above features, from a broad aspect, the present invention provides a bathtub support structure comprising a support frame structure formed of vertical support posts and lateral frame members for interconnecting the vertical posts at predetermined location in the support frame structure. Each of the vertical support posts has an adjustable support foot at a top end thereof. At least two spaced-apart adjustable connectors are adjustably secured to at least some of the vertical support posts and displaceable along a substantially horizontal axis. The connectors have an outer attachment head formed of a material for removal magnetic attachment to outer panel components. The panel components have magnetic connecting inserts secured to an inner surface thereof.

According to a further broad aspect of the present invention there is provided a method of constructing a free-standing bathtub support kit and side wall enclosure. The method comprises constructing components of a support frame structure formed of vertical support posts and lateral frame members adapted to be secured together by fasteners. The vertical support posts have an adjustable support foot securable at a top end thereof. At least two spaced-apart adjustable connectors are equidistantly securable to at least some of the vertical support posts and displaceable along a substantially horizontal axis. The connectors have an outer attachment head formed of a material for removable magnetic attachment to outer panel components. The method further comprises providing the outer panel components with magnetically attaching inserts adhesively secured to a rear surface thereof for removable connection to the lateral frame members and the adjustable connectors.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
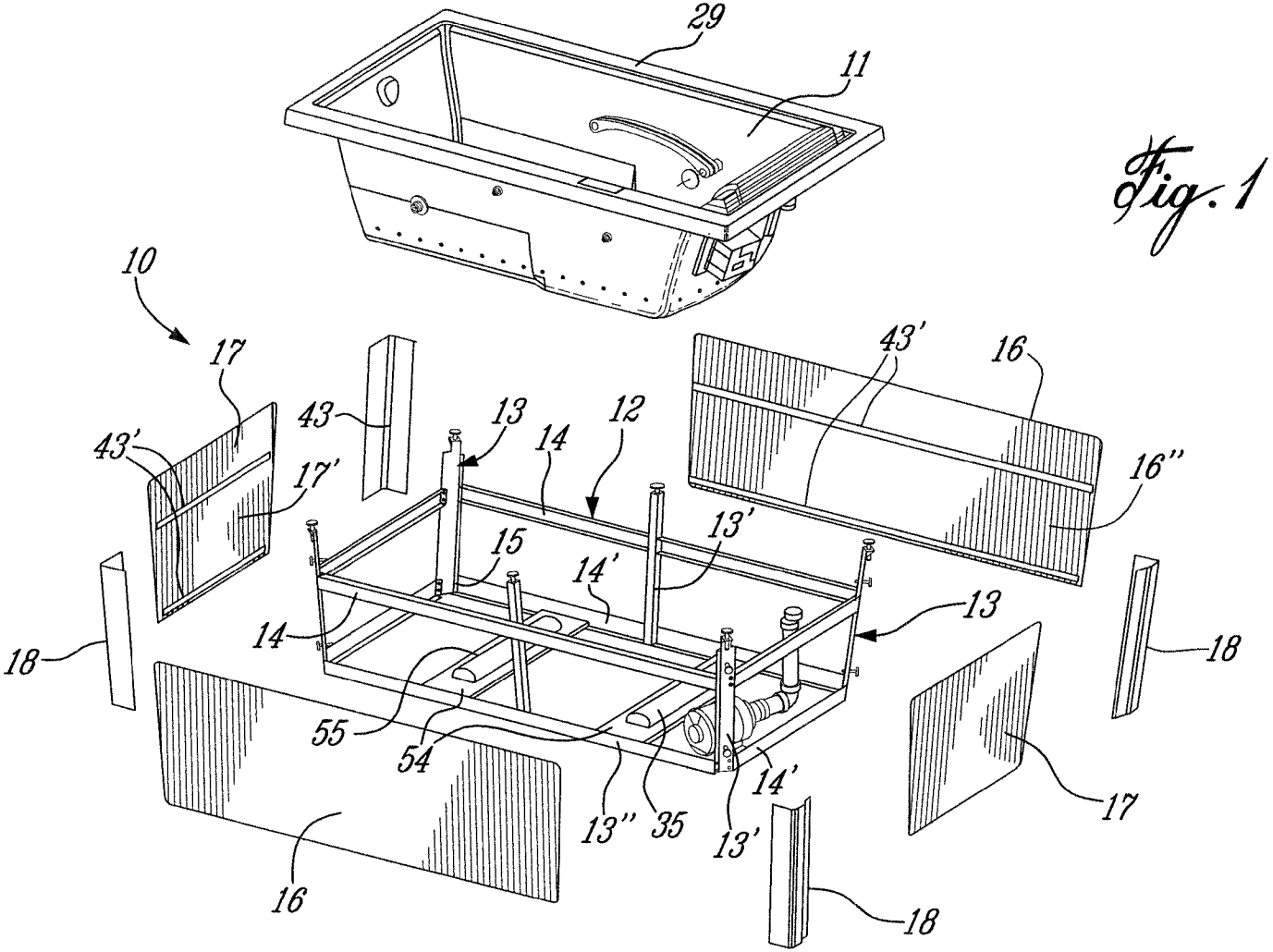
FIG. 1 is an exploded view illustrating the bathtub support structure and outer panel components constructed in accordance with the present invention and adapted to support and entirely enclose a drop-in type bathtub to form a free-standing bathtub structure.

Referring now to the drawings, and more particularly to FIG. 1, there is shown generally at 10 an exploded view of the bathtub support structure of the present invention adapted to support and form the side walls of a bathtub 11, herein a therapeutic bathtub such as an hydro massaging bathtub. The bathtub support structure comprises a support frame structure 12 which is formed of vertical support posts, herein corner posts 13 and intermediate support posts 13' and lateral frame members 14' which are interconnected together by fasteners 15 such as tapping screws or rivets, these being better illustrated in FIGS. 3 and 4. There are lower lateral frame members 14' at the base of the frame 12 and upper ones 14. A plurality of outer panel components, herein side wall panel component 16, end wall panel components 17 and corner panel components 18 are removably attachable and adjustable onto the support frame structure 12 as will be described later whereby to completely encircle the bathtub 11 to give it a pleasing aesthetic appearance in design and color. The panel components may be formed of various materials including wood components whereby to transform the bathtub into an article of furniture resembling other furnishings of a bathroom or spa area. The bathtub can be an existing bathtub converted to a free-standing one or a new bathtub.

Figure 2:
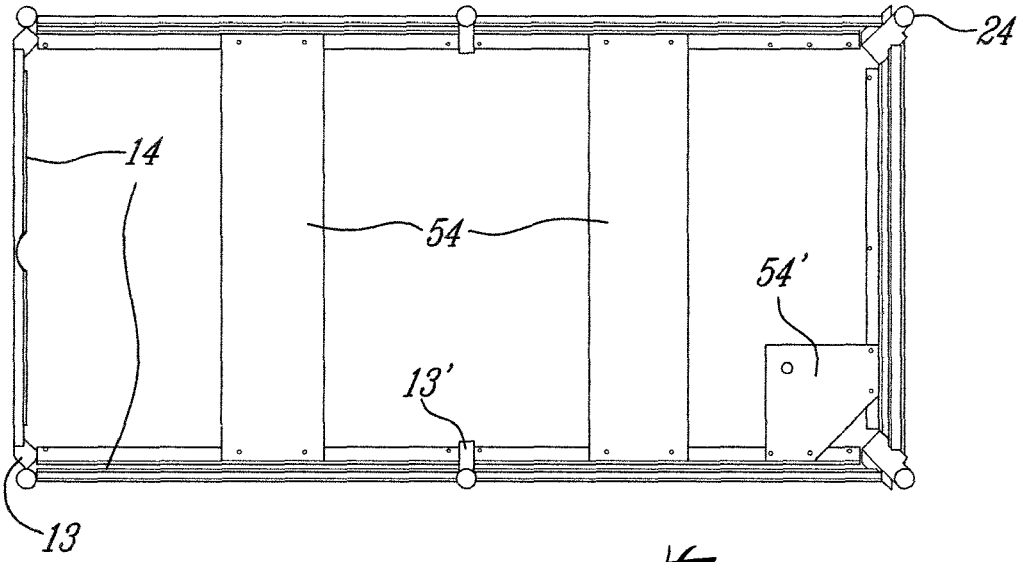
FIG. 2 is a top view of the support frame structure.
Figure 3:
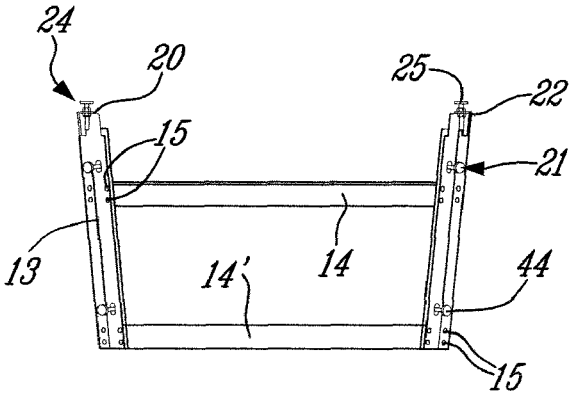
FIG. 3 is an end view of the support frame structure.
Figure 4:
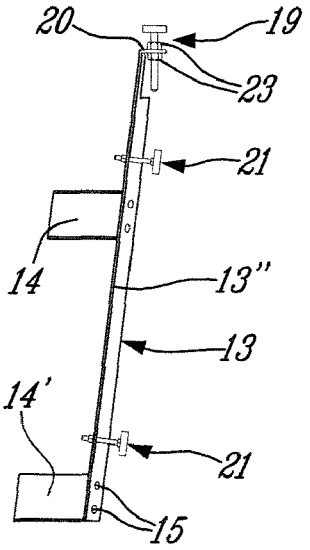
FIG. 4 is a fragmented end view showing the construction of a vertical corner post having an adjustable support foot secured at a top end thereof and adjustable connectors secured thereto.

With additional reference to FIGS. 2 to 4, and particularly FIG. 4, it can be seen that the vertical corner posts 13 have an adjustable support foot 19 secured to a top horizontal flange 20 of the vertical support posts. Also, at least two spaced-apart adjustable connectors 21 are secured to the corner vertical posts 13 and could also be connected to the intermediate support posts 14.

Figure 5:
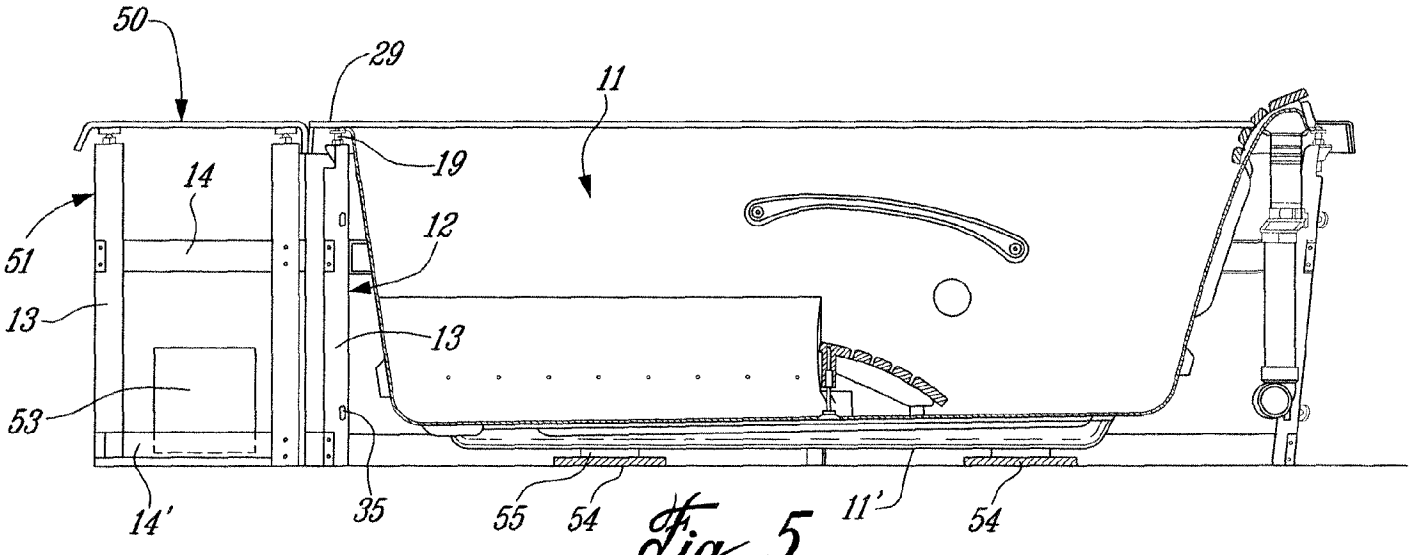
FIG. 5 is a section view showing the bathtub of FIG. 1 supported by the support frame structure of the present invention and wherein an extension shelf is secured and supported by the support frame structure of the present invention and herein adapted to house additional equipment for use with a therapeutic bathtub enclosure.
Figure 6:
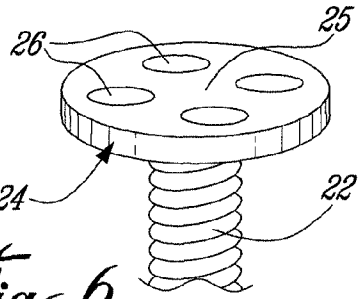
FIG. 6 is an enlarged view illustrating the construction of the connector disc of the adjustable support foot.
Figure 7:
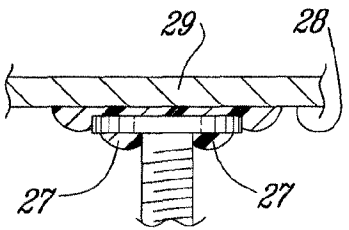
FIG. 7 is a partly sectioned and fragmented view showing the connector disc secured to an inner surface of a perimeter shelf of the bathtub by the use of an adhesive and wherein a connector disc is partly imbedded in the adhesive.

With additional reference to FIGS. 6 and 7 it can be seen that the adjustable support foot 19 is comprised of a threaded rod 22 which is threadably connected to the top flange 20 at the top end of the vertical posts 13. A pair of threaded nuts 23, one on each side of the flange 20, immovably secures the threaded rod to the top flange 20 at a desired position. The top end of the threaded rod 22 has a connector disc 24 secured thereto. The connector disc has a flat outer surface 25 which is provided with connecting means which is constituted by one or more through bore formations 26 provided in the connector disc whereby to permit the passage of an adhesive material 27 as shown in FIG. 7 which is squeezed between the flat outer surface 25 of the connector disc and the inner surface 28 of the perimeter shelf 29 of the bathtub 11, as shown in FIGS. 1 and 5. Accordingly, the adhesive material, either silicone or and appropriate glue, partly or fully embeds the connector disc therein to interconnect same with the inner surface 28 of the perimeter shelf 29.

Figure 8:
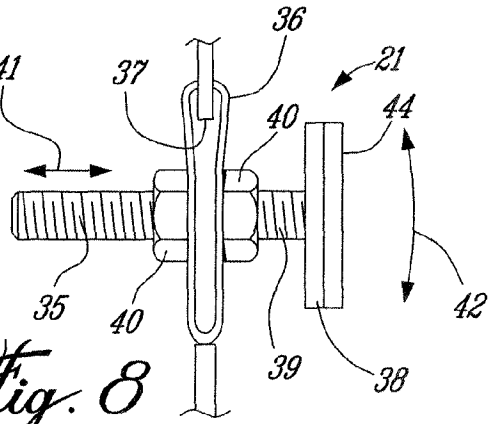
FIG. 8 is a partly fragmented enlarged view showing the construction of the adjustable connectors.
Figure 9:
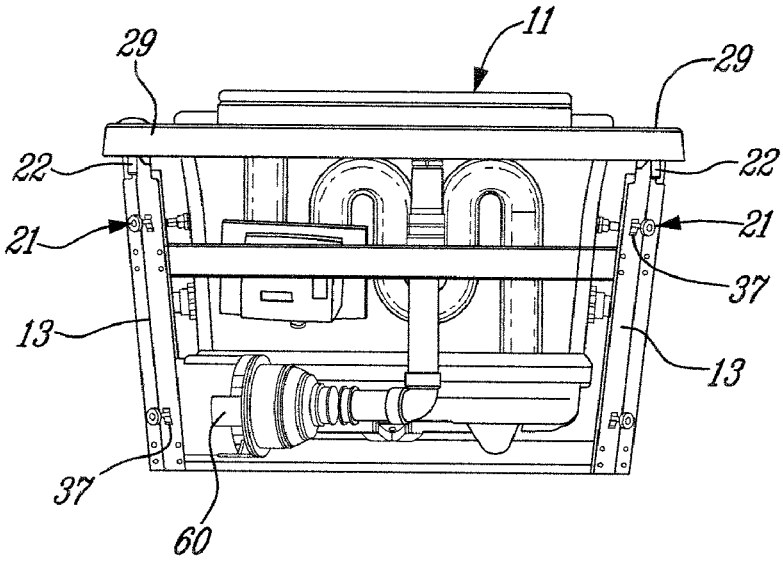
FIG. 9 is an end view of the support frame structure supporting the bathtub as illustrated in FIG. 5 and showing the location of equipment associated with the therapeutic bathtub.
Figure 10:
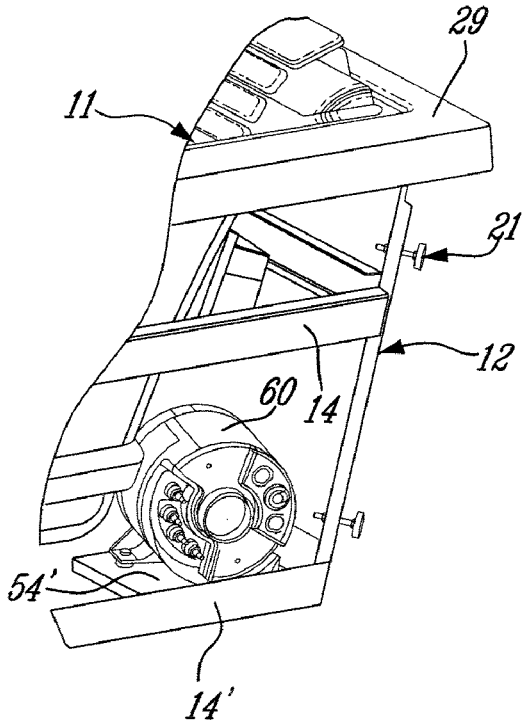
FIG. 10 is a fragmented corner view of the support frame structure and bathtub as illustrated in FIG. 5.

With reference now to FIG. 8, there is shown the construction of the adjustable connectors 21. As hereinshown the adjustable connectors are screw connectors which are provided with a threaded shaft 35 which is articulately secured by a retention bracket 36 which is clipped into a cavity 37 formed at predetermined spaced-apart locations in the corner posts 13, as better illustrated in FIGS. 4, 9 and 10. This provides for a flexible connection. An outer attachment head 38 is secured at a free outer end 39 of the threaded shaft and is provided on an outer surface thereof with a material for removal magnetic attachment to the outer panel components, herein the corner panel components 15 as will be described hereinafter. A pair of nuts 40, one on each side of the clip, retains the threaded shaft 35 at a desired extended position. Accordingly, the adjustable connector 21 is adjustable lengthwise as illustrated by arrow 41. It is also articulatable in the directions illustrated by arrow 42 by its connection to a flexible retention bracket 36. It is also conceivable that the retention head 38 may be articulately connected to the free end of the threaded shaft 35.

As shown in FIG. 8, the attachment head 38 may be formed of a magnetically attractive metal, such as steel, whereby to removably engage the corner component 18 which is provided with a magnetic tape 43 glued along a rear corner portion 18' thereof. Alternatively, the corner component 18 may be provided with a metal strip 43 instead of a magnetic tape and the attachment head 38 may have a magnetic tape 44 secured thereto on its outer face.

Because the bathtub enclosure provides for a humid environment, the lateral frame members and support posts are formed of galvanized steel material. The magnetic tapes 43 provided in the corner panel components and magnetic tapes 43' provided on the inner surfaces 16' and 17' of the side wall and end wall panel components 16 and 17, respectively, are provided with waterproof adhesives. These panels are formed of polymeric material or composite material such as plastics, fiberglass or mixtures thereof or any other suitable material, such as wood, whereby the free-standing bathtub enclosure resembles an article of furniture.

As better illustrated in FIGS. 2 to 4, the corner posts 13 are secured to the lateral frame members 14' and have their flat wall surface 13" disposed at an angle of about 45° thereto to facilitate its engagement with the corner components 18.

After the support frame structure 12 has been assembled it can then be connected to the perimeter shelf 29 of the bathtub 11 in a fashion as above-described by the use of silicone or glue 27 which is positioned on the flat outer surface 25 of the connector disc 24 of the adjustable support foot 19. When the bathtub 11 is disposed thereover the weight of the bathtub will apply the necessary pressure to connect the adjustable support feet 19 to the perimeter shelf, as illustrated in FIG. 7. The side wall panel 16 and end wall panel 17 can now be secured to the lateral frame members. The adjustable connectors 21 are then adjusted to fixedly connect the corner panel components 18 overlapping the side wall and end wall panel components. The lateral frame members 14 and 14' can also be cut to size to build a frame 12 to adapt to specific bathtub sizes and shapes.

As shown in FIG. 5, the support frame structure of the present invention provides for the construction of an adjustable support frame structure wherein an extension shelf, such as shown at 50 in FIG. 5, can be interconnected and secured adjacent the perimeter shelf 29. An extension frame structure 51 using corner support posts 13 and lateral frame members 14' may be provided as a kit attachable to the support frame structure 12 whereby to provide a shelf extension or other accessory to support products thereon or to provide for a greater space about the bathtub enclosure to house additional components 53 such as electronic components for music or video, telescopic television screens, motors, pumps, etc. It is also contemplated that the bathtub support structure of the present invention provides for the conversion of existing bathtubs into therapeutic-type bathtubs as the support frame structure 12 provides for an accessible working environment about the bathtub side walls to drill holes therein to connect water jets or air jets, etc.

As shown in FIGS. 1 and 5, the support frame structure 12 also has transverse base support members 54 immovably secured at opposed ends thereof to oppose lower ones 14' of the lateral frame members 14. These base support members are merely plywood planks, preferably marine plywood-type which are adapted to rest on a floor surface and suitable to receive support blocks 55 dimensioned for support engagement with the base 11', see FIG. 5, of the bathtub 11. Other support platforms, such as shown at 54', can be secured to the support frame to support accessories such as the motor 60 shown in FIGS. 9 and 10.

The bathtub support structure of the present invention also provides for a method of constructing a free-standing bathtub by providing the support frame structure and panel components and hardware as a kit. A user person would then construct the support frame structure as above-described and cut the lateral frame members to size, if necessary, to build the frame 12. The frame 12 is then secured to the bathtub by the use of silicone or adhesive. The side walls, end walls and corner panel components are then attached to the frame. The adjustable support feet 19 and adjustable connectors 21 also permit the adjustable positioning of the bathtub and surrounding panel components. This construction is simple and can be made with standard tools available to a handyman and does not require expensive qualified personnel other than perhaps the use of a plumber and electrician to make plumbing and electrical connections, depending on the type of free-standing bathtub being constructed.

It is within the ambit of the present invention to cover any obvious modifications of the preferred embodiment described herein provided such modifications fall within the scope of the appended claims. As an example, vertical posts may be positioned at various locations along the frame 12 depending on the number of vertical support posts required. Further, the frame can have a shape different than rectangular depending on the shape of the bathtub, i.e., round, oval or other non-rectangular shape.

We claim:

1. A bathtub support structure comprising a support frame structure formed of vertical support posts and lateral frame members for interconnecting said vertical posts at predetermined locations in said support frame structure, each said vertical support posts having an adjustable support foot at a top end thereof, at least two spaced-apart adjustable connectors adjustably secured to at least some of said vertical support posts and displaceable along a substantially horizontal axis, said connectors having an outer attachment head formed of a magnetic material for attachment to magnetic connecting inserts secured to an inner surface of a panel components, said adjustable support foot is comprised of a threaded rod threadably connected to a top end of said vertical post, and a connector disc having a flat outer surface, secured to a top end of said threaded rod, said connector disc being adapted to immovably connect said connector disc to an inner surface of a perimeter shelf of a bathtub.

2. A bathtub support structure as claimed in claim 1 wherein said connector disc has one or more through bore formations in said connector disc to permit the passage of an adhesive material compressed between said flat outer surface of said connector disc and said inner surface of said perimeter shelf to cause said adhesive material to interconnect said connector disc to said inner surface of said perimeter shelf by embedding at least a portion of said connector disc in said adhesive material.

3. A bathtub support structure as claimed in claim 2 wherein said adhesive substance is one of silicone or glue.

4. A bathtub support structure as claimed in claim 1 wherein said adjustable connectors are screw connectors having a threaded shaft articulately secured in a retention bracket secured to said vertical support posts to provide pivotal displacement of said outer attachment head secured at a free outer end of said threaded shaft.

5. A bathtub support structure as claimed in claim 4 wherein said attachment head is formed of a magnetically attracted metal to retain said outer panel components by removal connection with said inserts, said inserts being a magnetic material adhesively secured to a rear surface of said panel components.

6. A bathtub support structure as claimed in claim 4 wherein said attachment head has an outer surface thereof formed of magnetic material to retain said outer panel components by removal connection with said inserts, said inserts being a metallic material adhesively secured to a rear surface of said panel component.

7. A bathtub support structure as claimed in claim 4 wherein said vertical support posts and said lateral frame members are formed of galvanized steel, said inserts being magnetic tape inserts provided with an adhesive backing material.

8. A bathtub support structure as claimed in claim 4 wherein said panel components are formed of polymeric material, composite materials or wood.

9. A bathtub support structure as claimed in claim 4 wherein said support frame is a rectangular frame, some of said vertical support posts are corner posts, each said corner post being secured to said lateral frame members and disposed at an angle of about 45° thereto.

10. A bathtub support structure as claimed in claim 1 wherein said perimeter shelf is an extension shelf in which said bathtub is supported.

11. A bathtub support structure as claimed in claim 10 wherein there is further provided one or more extension panels secured to said perimeter shelf, said support frame structure having an extension support section formed of said vertical support posts and lateral frame members for supporting said perimeter shelf and extension panels.

12. A bathtub support structure as claimed in claim 4 wherein there is further provided transverse base support members immovably secured at opposed ends thereof to opposed lower ones of said lateral frame members adapted to rest on a floor surface, said base support members being adapted to fixedly receive support blocks thereon for support engagement with a base portion of a bathtub.

13. A bathtub support structure as claimed in claim 12 wherein said bathtub is a free-standing bathtub supported by said support frame structure with said panel components secured entirely about said bathtub and support frame structure.

* * * * *